United States Patent [19]

Zima

[11] Patent Number: 4,576,249

[45] Date of Patent: Mar. 18, 1986

[54] DEVICE FOR FIGHTING FIRES IN HIGHRISE BUILDINGS AND TOWERS

[76] Inventor: John P. Zima, 25058 N. Chestnut St., Newhall, Calif. 91321

[21] Appl. No.: 653,160

[22] Filed: Sep. 24, 1984

[51] Int. Cl.[4] ..... E04G 3/16; E04G 5/04

[52] U.S. Cl. ..... 182/82; 182/63; 182/131; 182/135; 182/148; 182/179; 187/18; 187/6

[58] Field of Search ..... 187/18, 6; 182/63, 141, 182/148, 129, 179, 128, 131, 134, 135, 82

[56] References Cited

U.S. PATENT DOCUMENTS

| | | | |
|---|---|---|---|
| 217,439 | 7/1879 | Zimmerman | 182/63 X |
| 278,249 | 5/1883 | Little | 182/63 X |
| 494,452 | 3/1893 | Witzel | 182/63 |
| 3,228,659 | 1/1966 | Sturm | 182/141 X |

FOREIGN PATENT DOCUMENTS

| | | | |
|---|---|---|---|
| 140282 | 8/1934 | Austria | 182/63 |
| 1951162 | 4/1971 | Fed. Rep. of Germany | 182/82 |

*Primary Examiner*—Ramon S. Britts
*Assistant Examiner*—Karen Chotkowski
*Attorney, Agent, or Firm*—Milton S. Gerstein

[57] ABSTRACT

A device for fighting fires in highrise buildings and towers is disclosed, whereby a pair of parallel arranged platforms are provided for alternative ascension up the side of the building in stepwise fashion. The upper platform is first released from fixed connection with the upper story to which it is attached and raised relatively to the lower platform still fixedly attached the story of the building below. After raising the upper platform to a higher story, it is fixedly attached to that story, whereupon the lower platform is released and raised toward the upper platform until it is positioned adjacent the story previously having the upper platform attached thereto. At this point, the lower platform is fixedly attached to that story. The process repeats a series of times to climb up the side of the building to the upper floors where a fire is burning to put out the fire and save lives. To descend, the process is simply reversed. Each platform is provided with clamping means for fixedly attaching the platform to a story of a building at which it is positioned. The clamping means are reciprocal between a clamping position fixing the platform to the story of the building, and a retracted release position to allow movement of the platform relative to the building. Each platform is also provided with hoisting equipment for lowering persons to the ground, and for allowing access to the ground below and the providing of necessary equipment to the upper floors.

5 Claims, 2 Drawing Figures

DEVICE FOR FIGHTING FIRES IN HIGHRISE BUILDINGS AND TOWERS

BACKGROUND OF THE INVENTION

The present invention is directed to a device for use in fighting fires in high-rise buildings and towers where hitherto it has been practicably impossible to reach the upper stories where the fire is and where persons may be stranded.

It is well-known that, with fires in high-rise buildings and towers, conventional firefighting devices and techniques are ineffective when trying to fight the fire on higher floors, because of the spacial constraints of ladders hoses, and the like. Thus, as has occurred, persons caught on those higher floors must either leap to their death below or be suffocated in the building itself. Present techniques have not been able to save these persons, and newly-tried methods have not been effective.

SUMMARY OF THE INVENTION

It is, therefore, the primary object of the present invention to provide a firefighting device that is effective in not only firefighting on higher stories of highrise buildings and towers, but is effective and capable of removing persons stranded on these stories and lowering them to safety to the street below.

Toward this end, the device of the present invention is provided with a first unit having a first supporting frame upon which firefighters may stand, and a second unit below the first unit also having a second supporting frame upon which firefighters may stand. Each of the units has a building-clutching means for fastening its respective supporting frame to the side of the building on fire, which building-clutching means is retractable and releasable to release the supporting frame from the building, for subsequent movement thereabove. The first and second supporting frames are interconnected by a lifting mechanism that provides relative movement in the vertical direction between the two supporting frames, so that the two units may "walk up" a building or tower to the upper stories thereof.

These units "walk up" or climb the building by a method where the top supporting frame is released from fixed connection to a story of the building by releasing and contracting its building-clutching means, whereupon the interconnecting lifting and lowering mechanism is activated to raise the top supporting frame relative to the fixed lower supporting frame, until the top supporting frame is adjacent the next higher story of the building or tower, upon which time the lifting and lowering mechanism is halted, and the top supporting frame's building-clutching means is again activated to clamp the top supporting frame to the next-higher story. Thereafter, the lower supporting frame is released from the story to which it was fixedly clamped, and thereafter raised to the story at which the top supporting frame was previously affixed, at which point the lower supporting frame is clamped thereto. This procedure is repeated a number of times until the supporting frames are positioned at the desired stories of the building or tower. At each story, to which the supporting frame is attached, conventional firefighting equipment provided on the supporting frames is utilized by the firefighters to fight the fire on the particular story of the building. Each supporting frame is also provided with appropriate means for lowering persons on the stories to safety to the street below, thus combining firefighting capabilities with life-saving capabilities on one single unit. The two supporting frames are lowered back down to the street level by reversing the procedure by which it climbed the building or tower. In the prefered embodiment of the invention, the raising and lowering mechanism is a scissor-type linkage operated by a piston-cylinder arrangement.

BRIEF DESCRIPTION OF THE DRAWING

The invention will be more readily understood with reference to the accompanying drawing, wherein.

DETAILED DESCRIPTION OF THE INVENTION

Figure 1:
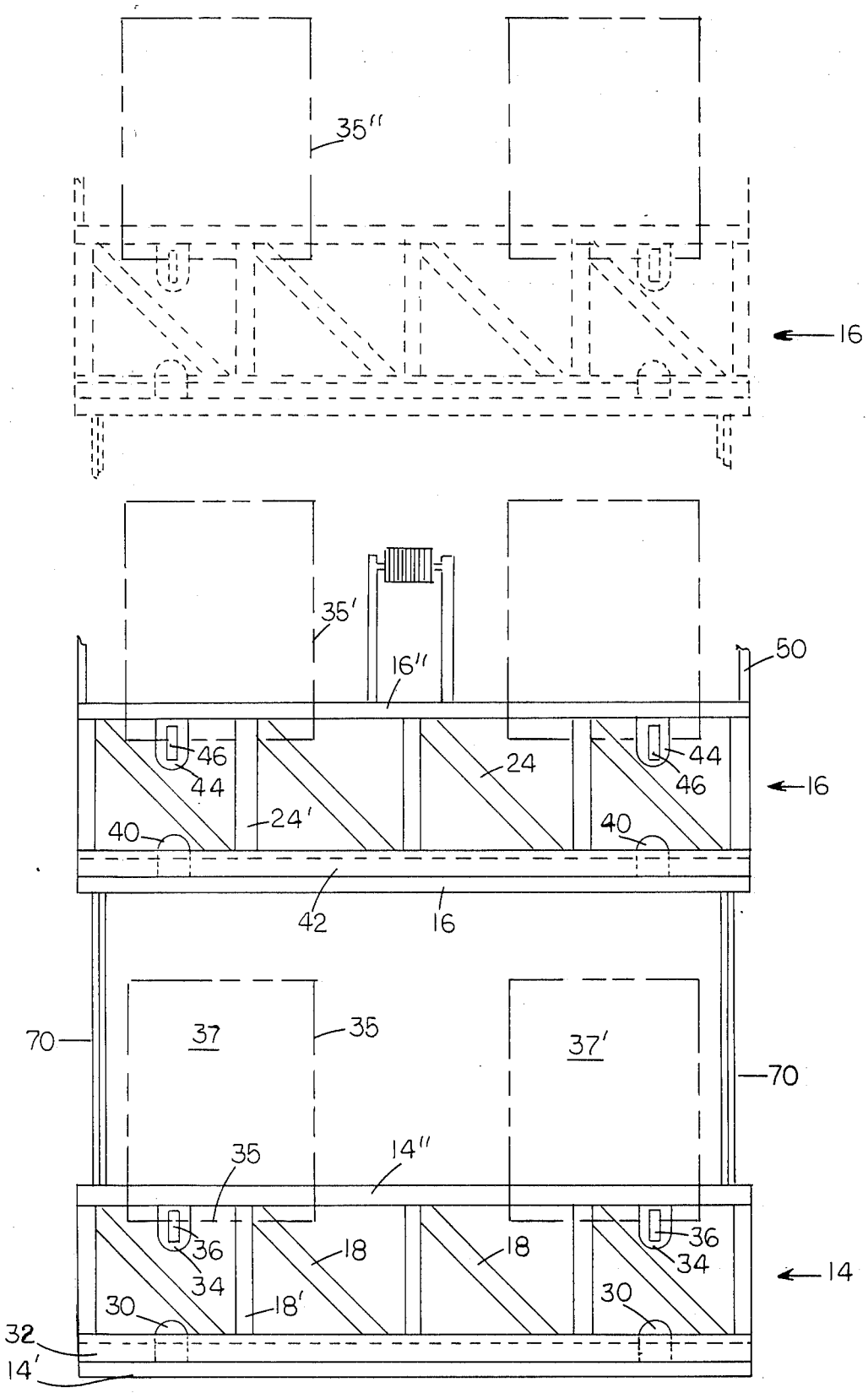
FIG. 1 is front elevational view of the device for fighting fires in highrise buildings of the present invention, which view is taken from the interior of the building to which the device is associated.
Figure 2:
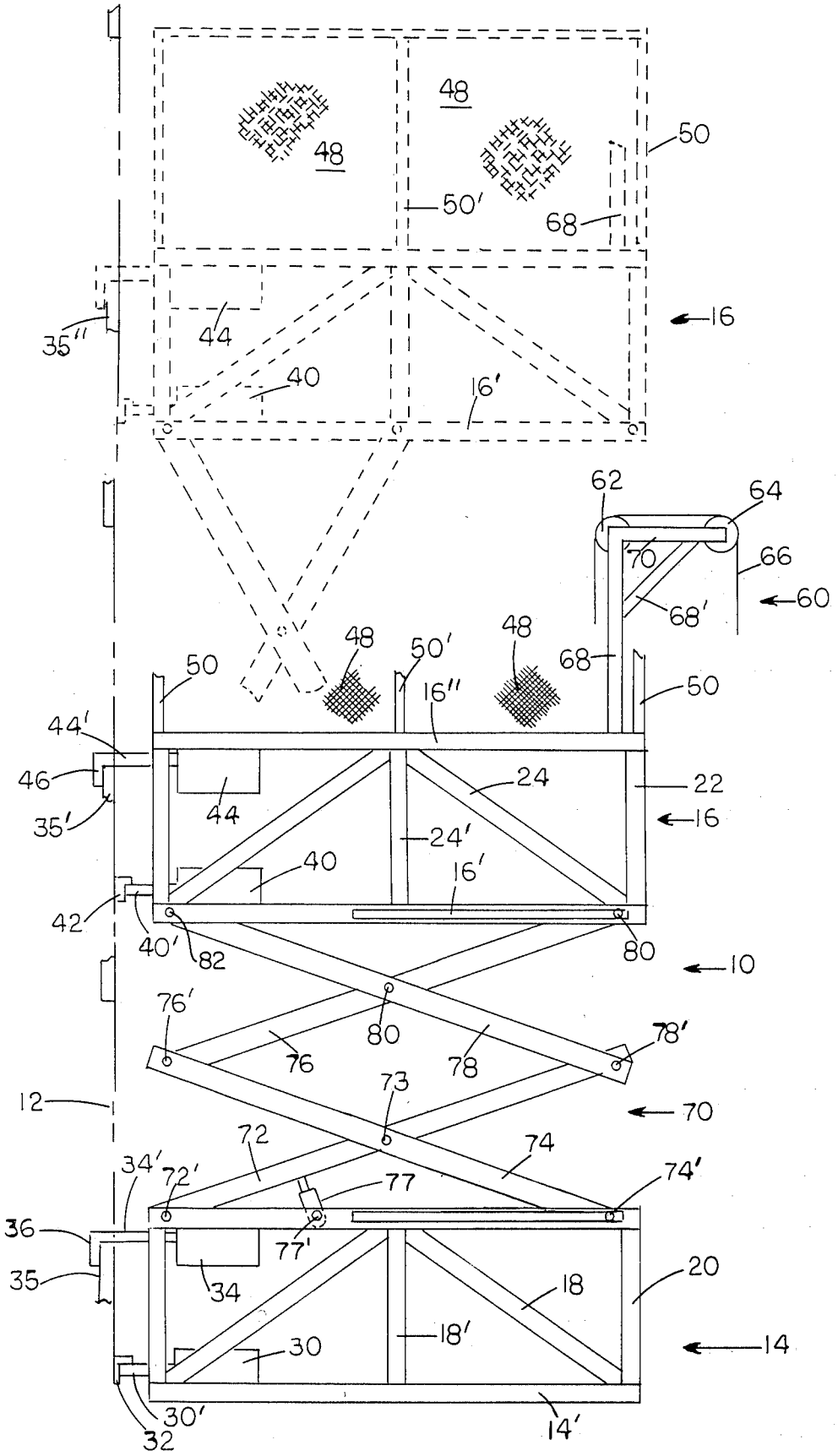
FIG. 2 is a side elevational view of the device of FIG. 1.

The invention is shown in detail in FIGS. 1 and 2, and is referred to generally by reference numeral 10. The device for fighting fires in highrise buildings and towers includes a lower platform element 14 having a lower base portion 14' upon which the firefighters may stand during their firefighting activities. The platform element 14 has an upper surface 14'' connected to the lower base portion 14' via corner beams 20, and supported by truss elements 18,18'. The platform element is preferably square or rectangular in cross-section, and open partially at its sides by the space between adjacent truss elements.

The platform element 14 is selectively fixable to a ledge or ledges of a story of the building 12 to which it is securable. Toward this end, a pair of hook securing elements 36 are provided adjacent the upper portion 14' of the platform, which hook element 36 forms the exterior end of a reciprocable piston rod 34' mounted for reciprocation by a cylinder 34. The hook element 36 is preferably L-shaped, as shown in FIG. 2, and abuts against a surface of the ledge of the story 35 at which it is shown positioned in FIG. 2. The lower base portion 14' also mounts a cylinder, 30, on either end thereof, which cylinders 30 slidingly reciprocate a piston rod 30' having at the end thereof a lower retractable lateral support element 32. As shown in FIG. 1, the two types of attaching elements are fixable to the story 35 at two adjacent ledges thereof, indicated by reference numerals 37 and 37'.

The device of the present invention also has an upper platform element 16 of the same construction as the lower platform element 14. The upper platform element 16 has trusses 24 and 24' for bracing the upper portion 16'' relative to the lower base portion 16'. A pair of spaced hook elements 46 is also provided adjacent the top surface portion 16'' which are connected to piston rods 44' and actuated by cylinders 44. An elongated lower lateral support element 42 is also provided similar to element 32 of the lower platform, and is retractable by piston rods 40' and actuated by cylinders 40.

The lower platform 14 and the upper platform 16 are each provided with upstanding wire-mesh screen elements 48 though only the upper platform 16 is shown having them in FIG. 2, this being so for the sake of clarity of the showing of the invention. These screens 48 are provided on the three sides of the platform not facing the face of the building, and are held in place by upstanding posts 50' in the center portion of each side, and by corner posts 50 at the corners of the platform. These screen elements serve to protect the firefighters from accidental falls from the platforms.

The platforms 14 and 16 are interconnected by a scissor-type linkage mechanism used for moving one platform relative to the so as to ascend or descend along the face of the building in the manner to be described below. This scissor-type linkage mechanism includes a pair of scissor-like linkage means on either side of the platforms, as shown in FIG. 1. Each linkage means 70 includes a first lower scissor element made up of legs 72 and 74 pivoted together at the center portions thereof by pivot pin 73. The lower end of leg 72 is pivoted to the upper portion of the platform 14 by pin 72' and at its upper end is pivoted to the lower end of a leg 78 via pin 78'. The lower end of the leg 74 is pivotally and slidingly mounted in the upper portion 14'' of the platform 14, in any conventional manner, as by a slotted groove in the side of the upper portion 14'' allowing for the sliding movement of the end of the leg 74 pivotally connected to a pin sliding in the groove. The upper end of the leg 74 is pivotally connected to the lower end of a leg 76 via a pin 76', while the upper end of the leg 76 is pivotally connected and slidingly connected to the lower base portion 16'' of the upper platform, in the same manner as the end of the leg 74 connected to platform 14. The upper end of the leg 78 is also pivotally connected to the lower base portion 16' of the platform 16 via pin 82. An actuation cylinder with reciprocating piston, indicated generally by reference numeral 77, provides the motive force for elevating and lowering the scissor linkage means so as to move the platforms relative to each other, in a desired manner, and is pivoted to the upper portion of the lower platform 14 by pivot pin 77'. As clearly shown in FIG. 2, upon extension of the piston of the actuating cylinder 77, the scissor-type linkage mechanism is elongated, so as to raise the upper platform relative to the lower one when the lower platform is held secure by the hook elements 36 and element 32 to the building, and when the upper platform 16 is released from the building after its respective attaching elements have freed it from the story of the building, 35' in FIG. 2.

Upon contraction of this actuating cylinder 77, the scissor linkage mechanism is contracted, thus bringing closer together the two platforms, which, as described below, is undertaken after the upper platform has been raised to the next higher story and clamped thereto, so that the lower platform 14 may then be raised to the story previously occupied by the upper platform 16, so as to "walk up" the side of the building.

The operation and use of the device of the invention will be discussed. Assuming that the lower platform 14 is clamped to the lower story 35 of the building 12, at the window ledges thereof, by the spaced-apart hook elements 36 and elongated support element 32, and that the upper platform 16 is clamped to the next higher story 35' by its hook elements 46 and support element 42, each actuating cylinder 77 is first actuated to extend its piston rod a slight distance so as to lift the upper platform 16 a slight distance so that the hook elements 46 are elevated above the ledges of the story 35', which actuation of the cylinder 77 is preceded by the actuation of the cylinders 40 to release the support element 42 from contact with the side of the building. After the hook elements have cleared the ledges of that story, the hook elements are withdrawn by the operation of the cylinders 44, and the actuating cylinders 77 continue extension until the upper platform 16 is positioned adjacent the next higher story 35''. The upper platform is elevated to a position slightly above the point where the hook elements are coplanar with the top of the ledges of that story, so that the hook elements may first be extended and then lowered downwardly into hooking engagement with the top surfaces of the ledges. Thus, after the upper platform has been raised this distance slightly higher than point where the hook elements are coplanar with the top surface of the story ledges, the actuating cylinders 77 are operated to slightly retract to thus cause the hook elements to descend into clamping relationship with the top ledges, as shown in dotted lines in the figures. Thereafter, the cylinders 40 are operated to extend their rods to force the support element 42 against the surface of the building adjacent that respective story.

After having moved the upper platform to its next higher story and clamped it thereto, the lower platform is then released in the same manner as described above with respect to the upper platform 16. After having released the lower platform from the story 35, the actuating cylinders 77 are actuated to retract, to thus pull up the lower platform, with the upper platform 16 acting as the fixed support. The lower platform is first allowed to clear the ledges of the lower story 35, at which point the cylinders 34 are operated to retract the hook elements toward the platform. The cylinders 30 are, of course, first operated to release the lower platform from secure contact with the building to allow for the upward movement of the lower platform in the first place by actuation of the cylinders 77. Thereafter, after having raised the lower platform to the story 35', it is positioned slightly above the edges of the story 35' to allow for the extension of the hook elements by the cylinders 34, whereafter the platform 14 is lowered to clamp the hook elements to the ledges of the story, and thereafter actuating the cylinders 30 to extend the support element 32, to fix in place the lower platform at the story 35'.

The upper platform is provided with a hoist for allowing access to be ground, and for lowering people to safety, as well as for hoisting equipment to the platform, such as fire extinguishers, and the like. The hoist 83 is of conventional design.

While the support element 32 has been shown to be one elongated lateral support element, it is within the breadth and scope of the invention to allow for two spaced apart support elements 32, each operated by one of the hydraulic cylinders 40. The same also holds for the lateral support element 42.

While the upper platform has been shown to include a series of screens on the upper portion thereof, the lower platform element may or may not be provided with such screens, depending upon the actual structural relationship between the scissor linkage means and the top surface of the lower platform element. Each hydraulic cylinder 77 may be appropriately arranged so as to afford the greatest lift capacity for the desired cylindrical capacity used. The procedure for climbing the face of the building is repeated a number of times until the device of the present invention has reached the topmost stories of the building. Thereafter, the process is reversed in order to lower the device down the face of the building to street level. In this descent of the device, the lower platform is first released from the story of the building, and then clamped to the story therebelow, without the need of having to first overshoot the story therebelow, since the hook elements in their descent will hook over the top ledge surfaces of the story after actuation of the appropriate cylinders. After the lower platform has been clamped to the lower story, the upper platform is then released from its upper-most story and lowered to the story therebelow, in the same manner. The process is repeated a number of times until the street level is reached.

To initially set up the device of the present invention, a highrise building or tower may be provided with such a device from its construction stage, so as to be permanently affixed to one side of the building or to more than one side. For those buildings not having a permanent device, a specially-made support may be provided for fire trucks for transporting the device to the site of the fire, which truck will have appropriate lifting means for arranging the lower platform adjacent a lower story of the building for clamping thereto, so that the whole procedure may be initiated and set up for the climbing up the face of the building.

While specific embodiments have been described, it is to be understood that numerous changes and modifications may be made therein without departing from the scope and spirit of the invention as set out in the appended claims. For example, the scissor linkage mechanism may be replaced by a telescoping mechanism, or any other lifting mechanism capable of performing the necessary lifting and lowering operations of the device of the present invention.

What I claim is:

1. A device for fighting fires in highrise buildings and towers, comprising:

a first lower platform frame means upon which firefighters may stand for support;

a second upper platform frame means upon which firefighters may stand for support above said first lower platform frame means and interconnected therewith;

means interconnecting said first lower platform frame means and said second upper platform frame means for adjustably varying the distance between said first and second supporting frame means for selective use thereby;

said first and second platform frame means comprising means for releasably and fixedly mounting said platform frame means to a portion of a building adjacent a particular story of a building on fire such that the upper platform frame means and lower platform frame means may be moved along the side of the building;

each of said means for releasably and fixedly mounting comprising a retractable hook means movable between a first locking position and a second unlocking position, said hook means being attached to a story of a building on fire in said first position; and a first and second extensible and retractable support means mounted to said first and second platform frame means, respectively, for movement between two positions;

said support means being mounted below said hook means on each respective platform frame means.

2. The device according to claim 1, wherein each of said first and second platform frame means comprises hoist means for raising and lowering equipment from the ground, and for lowering persons therebelow.

3. The device according to claim 1, wherein said means interconnecting said platform frame means comprises scissor linkage means having a first end connected to an upper portion of said first lower platform frame means, and a second end connected to a lower portion of said second upper platform frame means.

4. The device according to claim 3, wherein said means interconnecting said upper and lower platform frame means further comprises power means for extending and contracting said scissor linkage means to vary the distance thereby between said upper and lower platform frame means.

5. The device according to claim 4, wherein said first end of said scissor linkage means is pivotally connected to said upper portion, and said second end is pivotally connected to said lower portion.

* * * * *